US010982501B2

(12) United States Patent
Salem Saleh Alameri

(10) Patent No.: US 10,982,501 B2
(45) Date of Patent: Apr. 20, 2021

(54) BLOWOUT PREVENTER RAM PACKER ASSEMBLY

(71) Applicant: Abu Dhabi National Oil Company, Abu Dhabi (AE)

(72) Inventor: Fahed Salem Saleh Alameri, Abu Dhabi (AE)

(73) Assignee: Abu Dhabi National Oil Company

( * ) Notice: Subject to any disclaimer, the term of this patent is extended or adjusted under 35 U.S.C. 154(b) by 0 days.

(21) Appl. No.: 16/619,165

(22) PCT Filed: Jan. 10, 2019

(86) PCT No.: PCT/IB2019/050187
§ 371 (c)(1),
(2) Date: Dec. 4, 2019

(87) PCT Pub. No.: WO2019/138351
PCT Pub. Date: Jul. 18, 2019

(65) Prior Publication Data

US 2020/0370388 A1 Nov. 26, 2020

Related U.S. Application Data

(60) Provisional application No. 62/615,985, filed on Jan. 11, 2018.

(51) Int. Cl.
*E21B 33/06* (2006.01)

(52) U.S. Cl.
CPC ..... *E21B 33/063* (2013.01); *E21B 33/06* (2013.01)

(58) Field of Classification Search
CPC ..... E21B 33/06; E21B 33/061; E21B 33/062; E21B 33/063
See application file for complete search history.

(56) References Cited

U.S. PATENT DOCUMENTS 1,790,904 A * 2/1931 Creighton ..... E21B 33/06 285/123.6
2,527,068 A * 10/1950 Murray ..... E21B 33/062 277/325
2,947,508 A * 8/1960 Allen ..... E21B 33/062 251/1.3
4,550,895 A * 11/1985 Shaffer ..... E21B 33/062 251/1.3

(Continued)

FOREIGN PATENT DOCUMENTS

EP 0 439 896 A1 8/1991
WO 2014/105627 A2 7/2014

OTHER PUBLICATIONS

PCT/IB2019/050187 Written Opinion of the International Searching Authority, dated Feb. 25, 2019, 5 pages.

(Continued)

*Primary Examiner* — Umashankar Venkatesan
(74) *Attorney, Agent, or Firm* — Stinson LLP

(57) ABSTRACT

The invention relates to a ram assembly of a blowout preventer and particularly to a pipe ram front packer assembly (100) suitable for a single use, which includes a packing (110) formed of a metal material, where the metal material is sufficiently deformable to collapse around an outer periphery of a drill pipe to seal the annulus of a preventer bore.

21 Claims, 7 Drawing Sheets

(56) References Cited

U.S. PATENT DOCUMENTS

| | | | | | |
|---|---|---|---|---|---|
| 4,553,730 | A * | 11/1985 | Vicic | E21B 33/062 | 251/1.3 |
| 4,703,938 | A * | 11/1987 | Fox | E21B 33/062 | 277/325 |
| 5,009,289 | A * | 4/1991 | Nance | E21B 19/10 | 188/67 |
| 6,296,225 | B1 * | 10/2001 | Watts | E21B 33/062 | 251/1.3 |
| 2003/0024705 | A1 * | 2/2003 | Whitby | E21B 33/064 | 166/363 |
| 2012/0012339 | A1 * | 1/2012 | Weir | E21B 33/062 | 166/386 |
| 2017/0167219 | A1 | 6/2017 | Wang et al. | | |

OTHER PUBLICATIONS

PCT/IB2019/050187 International Search Report, dated Feb. 25, 2019, 4 pages.

* cited by examiner

BLOWOUT PREVENTER RAM PACKER ASSEMBLY

CROSS-REFERENCE TO RELATED APPLICATION

This application is a U.S. national stage application of PCT/IB2019/050187, filed Jan. 10, 2019, which claims the benefit of U.S. Provisional Patent Application No. 62/615,985, filed Jan. 11, 2018, the contents of which are incorporated by reference in their entirety for all purposes.

FIELD OF THE INVENTION

The invention relates to a ram assembly of a blowout preventer and more particularly to an improved pipe ram front packer assembly.

BACKGROUND OF THE INVENTION

Blowout preventers are used extensively throughout the oil and gas industry. Typical blowout preventers are used as a large specialized valve or similar mechanical device that seal, control, and monitor oil and gas wells. Blowout preventers are generally split into two main categories, the ram blowout preventers and the annular blowout preventers.

Ram units, used in the blowout preventers may be used to shear and seal the drill pipe or may be used to seal the annulus around the drill pipe by sealing against the pipe. The former shearing rams and latter pipe rams are usually used in combination with one another where a blowout preventer consists of stacked preventers along a single pipe. The stacked configuration provides for redundancies and back-ups should one or more of the rams fail.

The blowout preventer includes a main housing with a vertical bore. Ram bonnet assemblies may be bolted to the housing, according to any means known in the industry. Each bonnet assembly includes a piston which is laterally movable within a ram cavity of the bonnet assembly by pressurized hydraulic fluid acting on one side of the piston. The opposite side of each piston may be connected to a ram or packer. Depending on whether the ram is a shear ram, for shearing the drill pipe, or a pipe ram, for sealing the annulus between the bore and outer periphery of the pipe, so the design of the ram will differ.

A shear ram is designed to move laterally toward the vertical bore of the blowout preventer to shear or seal off on any object located therein. A pipe ram typically has a semi-circular opening in its front face to form a seal about half of the outer periphery of the pipe. When the opposing pipe rams are closed, the opposing pipe rams engage each other and seal the entire periphery of the object. The annulus between the bore and the pipe is thus effectively sealed.

A pipe ram assembly includes a packing body composed of an elastomeric or rubber material. The packing material abuts the outer periphery of the pipe to form the seal, when the rams are closed around the drill pipe. The elastomeric or rubber material of the packing body is positioned between upper and lower plates.

At high temperature or in the face of a high concentration of sour gases, such as $H_2S$ concentration above 35%, ram packers become susceptible to mechanical wear. At high temperatures, such as over 200° C., the elastomeric or rubber material of a ram packer can degrade and breaks-up, and can extrude past the upper plate of the ram packer into the blowout preventer borehole. The collapse of the packer directly affecting the sealing capabilities of the ram packer.

Further, high sour gas concentrations can erode the elastomeric or rubber material. When this occurs, the gas may permeate up through the annulus and to the surface. The noxious gases cause dangers to the rig and workers above. For these reasons a well would be closed, or alternatively could not be available for exploration.

OBJECT OF THE INVENTION

It is an object of the current invention to address these problems, at least partly, and provide a pipe ram packer assembly that is suitable for sealing off on an object in a bore of a blowout preventer, particularly at high temperature. More particularly, a pipe ram packer assembly that is suitable for sealing off on an object wherein the seal is largely resistant to $H_2S$ concentrations of up to and above 35%, or other high sour gases.

SUMMARY OF THE INVENTION

In accordance with the invention there is provided a packer assembly for a pipe ram wherein the assembly includes;

a packer body having a front face comprising an upper plate and a lower plate;

a packing, having a front surface for engaging an object, positioned between the plates, wherein;

the packing is a collapsible metal material.

The packing may extend past the front face of the upper plate and the lower plate.

The metal material may comprise of alloy metal 718; further the material may comprise stainless steel A182; further still the material may comprise aluminium; even further still the material may comprise of a metal which may be different to alloy metal 718 or stainless steel A182 or aluminium, provided such metal is sufficiently collapsible by activated pressure of a piston to deform around an outer periphery of a drill pipe.

The metal material may comprise anti-corrosive properties; further where the anti-corrosive properties may require the metal to withstand 'high sour' formations; further still where the metal may be required to withstand $H_2S$ concentrations of up to 35%.

The metal material may comprise heat resistant properties; further where the heat resistance includes heat fluctuations; further still where the heat resistance includes temperatures at or above about to 250° C.

The metal material may comprise chemical influence resistance.

The metal material may comprise metal which is resistant to mechanical wear and degradation; further where the material is resistant to beading or crumbling.

The configuration of the packer body may be compatible with a cavity of a blowout preventer and interchangeable with ram front packers.

The upper plate and the lower plate may include a recess in the front face for receiving a drill pipe; further the packing may include a recess in the front surface for receiving a drill pipe.

The packer body may include a keying formation along the face, further the keying formation of opposing packer bodies may guide opposing rams, when brought together, to interlock to align the opposing rams.

The packer body may include an attachment arrangement located along the body for attaching the body to a means for moving the rams.

The packing may be fastened between the upper plate and the lower plate and the packer body by using a fastening means; further where the fastening means fastens the packing to the body by extending through the packing and the upper plate and the lower plate and the packer body; further still where the fastening means may be; a set of bolts, or threaded screws.

The invention further provides for the packer body to be substantially U-shaped; further where the U-shaped body is formed of a pair of opposing arms; further still where each distal end of the arms provide for the front face; even further still where the packing may be positioned between the opposing arms.

The packing may extend past the front face of the opposing arms.

The packer body may include a recess in the front face for receiving a drill pipe; further the packing may include a recess in the front surface for receiving a drill pipe.

The packing may be fastened between the opposing arms of the packer body and fastened to the body using a fastening means; further where the fastening means fastens the packing to the body by extending through the packing and the packer body; further still where the fastening means may be; a set of bolts, or threaded screws.

The invention provides further for the front surface of the packing to be conterminous with the front face.

BRIEF DESCRIPTION OF THE DRAWINGS

These and other features of the invention will become more apparent by the following description of the embodiment, which is made by way of example, with reference to the accompanying drawings in which.

BRIEF DESCRIPTION OF THE PREFERRED EMBODIMENTS

Referring to FIGS. 1 to 4 which show selected components of a blowout preventer arrangement used to seal, control and monitor oil and gas wells. The Figures refer to components which are commonplace in the art, and include; a blowout preventer, a first and a second type of ram assembly and a packing body, in that order.

Figure 1:
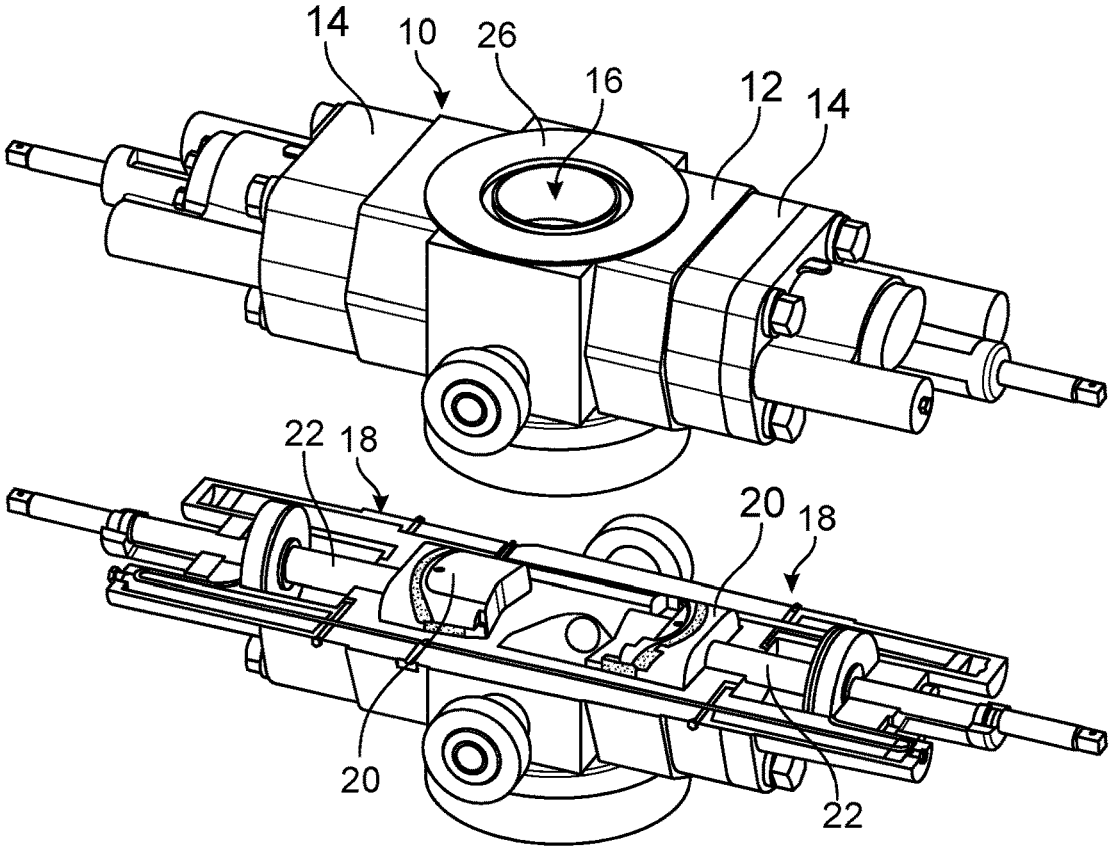
FIG. 1 (Prior Art)
FIG. 1: shows a blowout preventer in perspective and in lateral cross-section.

FIG. 1 shows a blowout out preventer 10. The preventer includes a housing 12 and a pair of bonnet assemblies 14 which are diametrically opposed around a vertical bore 16 which extends through the centre of the housing.

A drill pipe (not shown) extends through the central bore 16 when the preventer 10 has been installed on a wellhead. An annulus (also not shown) is formed between the inner surface of the bore and the outer periphery of the drill pipe.

Each bonnet assembly 14 houses a ram assembly 18. The ram assemblies comprise a packer assembly 20 connected to a rod 22. These rams are connected to a means for moving the rams in two directions. The first direction being inwardly to close the central bore 16, and a second and opposing direction, outwardly, to open the bore.

Preventer 10 is connected to a wellbore mouth (not shown) by securing flange 24 to the mouth. Additional preventers may be stacked above one another by securing the flange to connection member 26. The stacked preventers provide additional seals and redundancies for sealing the wellbore mouth.

Figure 2:
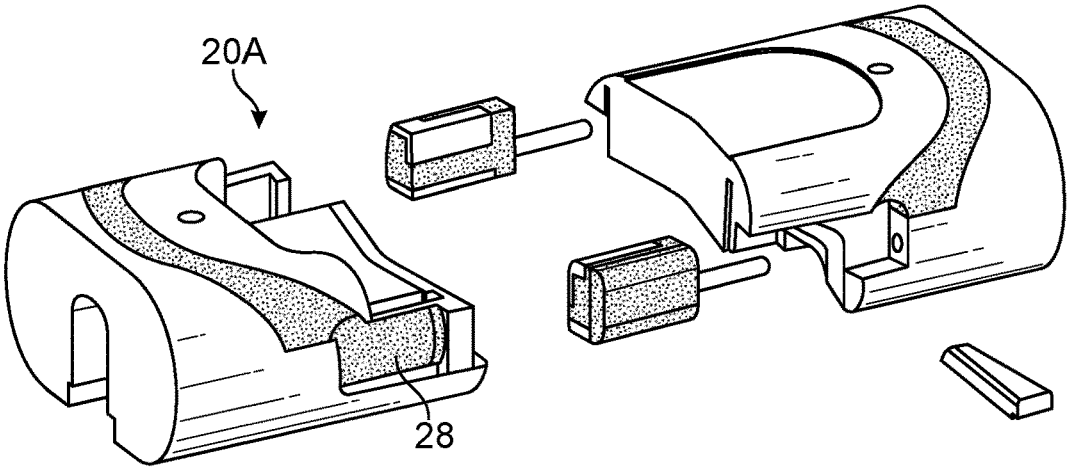
FIG. 2(Prior Art)
FIG. 2: shows a perspective view of a packer assembly available in the art.
Figure 3:
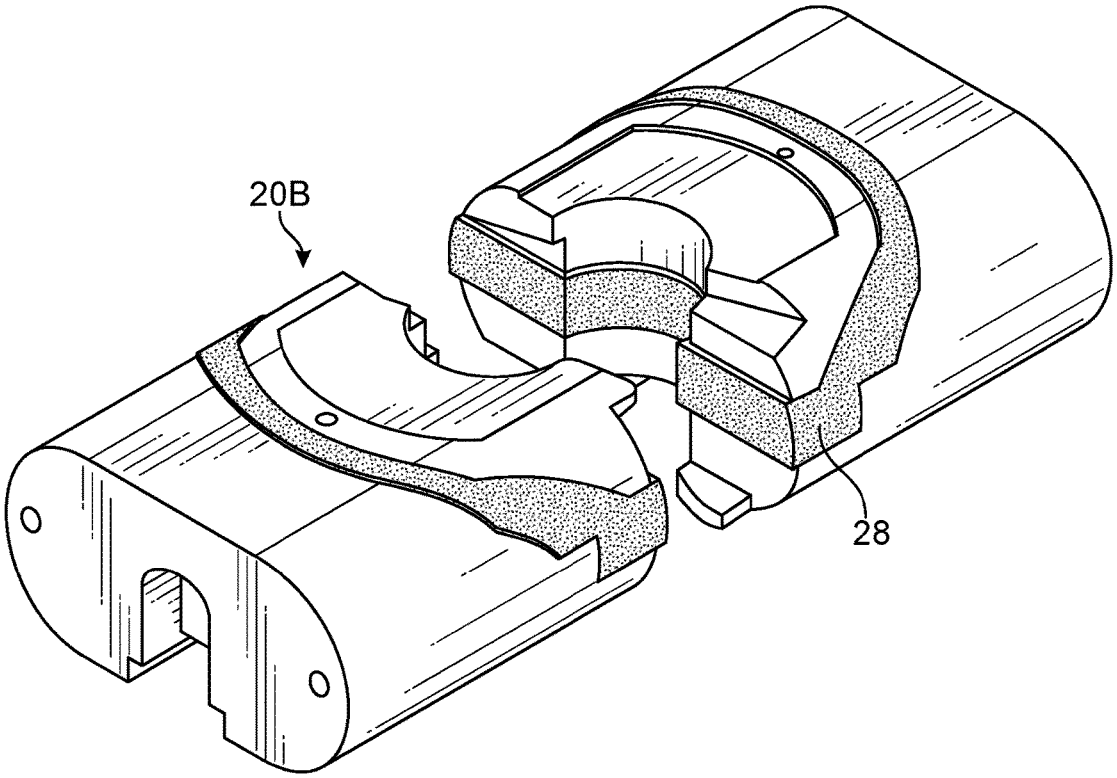
FIG. 3 (Prior Art)
FIG. 3: shows a perspective view of a further packer assembly available in the art.

Turning to FIGS. 2 and 3 which show examples of two different types of ram packer assemblies. FIG. 2 shows a shear blind ram 20A, while FIG. 3 shows a pipe ram 20B. A packer body 28 is housed within ram assemblies 20A and 20B.

The shear blind ram, as shown in FIG. 2, will shear the drill pipe in the bore and then bend the lower section of the sheared pipe. This allows the rams to close and seal. A variation to this shear ram is a TYPE 72 shear ram which closes on the pipe. The pipe is sheared and the ends are continually pressed until fish-tails form, further sealing the pipes.

FIG. 3 shows the pipe ram 20B, including the packer 28. The pipe ram includes an opposing pair of plates with a packer positioned there between, and a recessed area along a front face of the ram for receiving the drill pipe when the rams are closed. The packers, commonly formed of an elastomeric material, provide a tight seal around the pipe, when the rams are moved inwardly, to close off and effectively seal the area beneath the rams from the area above it.

Figure 4:
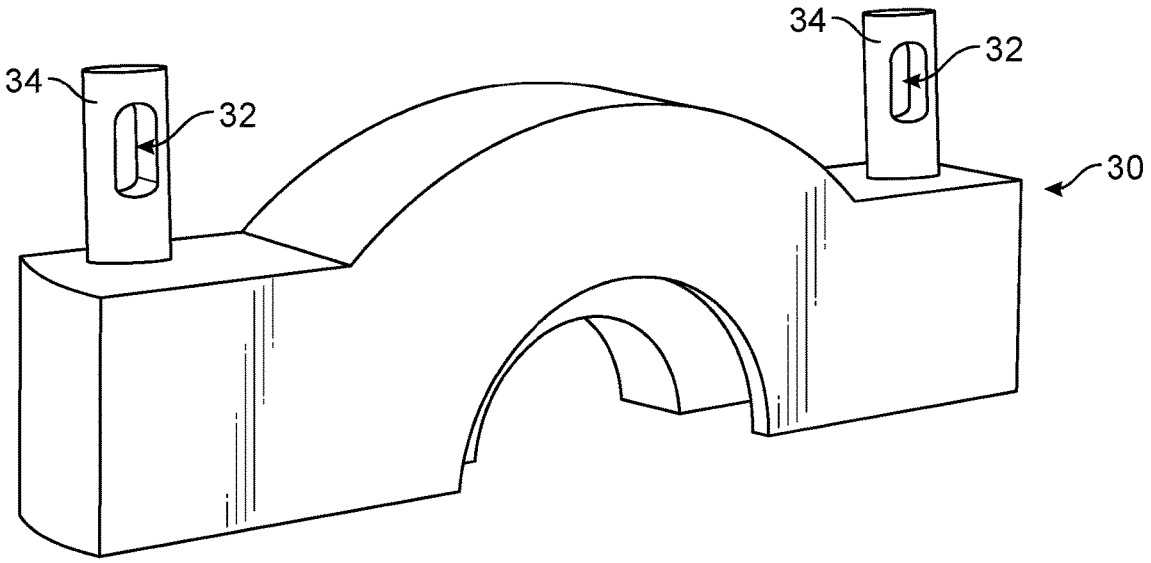
FIG. 4 (Prior Art)
FIG. 4: shows a perspective view of a packing material for use with the ram assemblies shown in FIGS. 2 and 3.

FIG. 4 shows a packer body 30 which is commonly used with different types of ram assemblies. The packer is commonly formed of an elastomeric or rubber material. The packer includes a pair of apertures 32 which extend through securing means 34. The securing means and apertures are used in securing the packer to a ram assembly, either in first installation of the ram, or once a packer has become worn and must be replaced in a ram assembly with a new packer.

Figure 5:
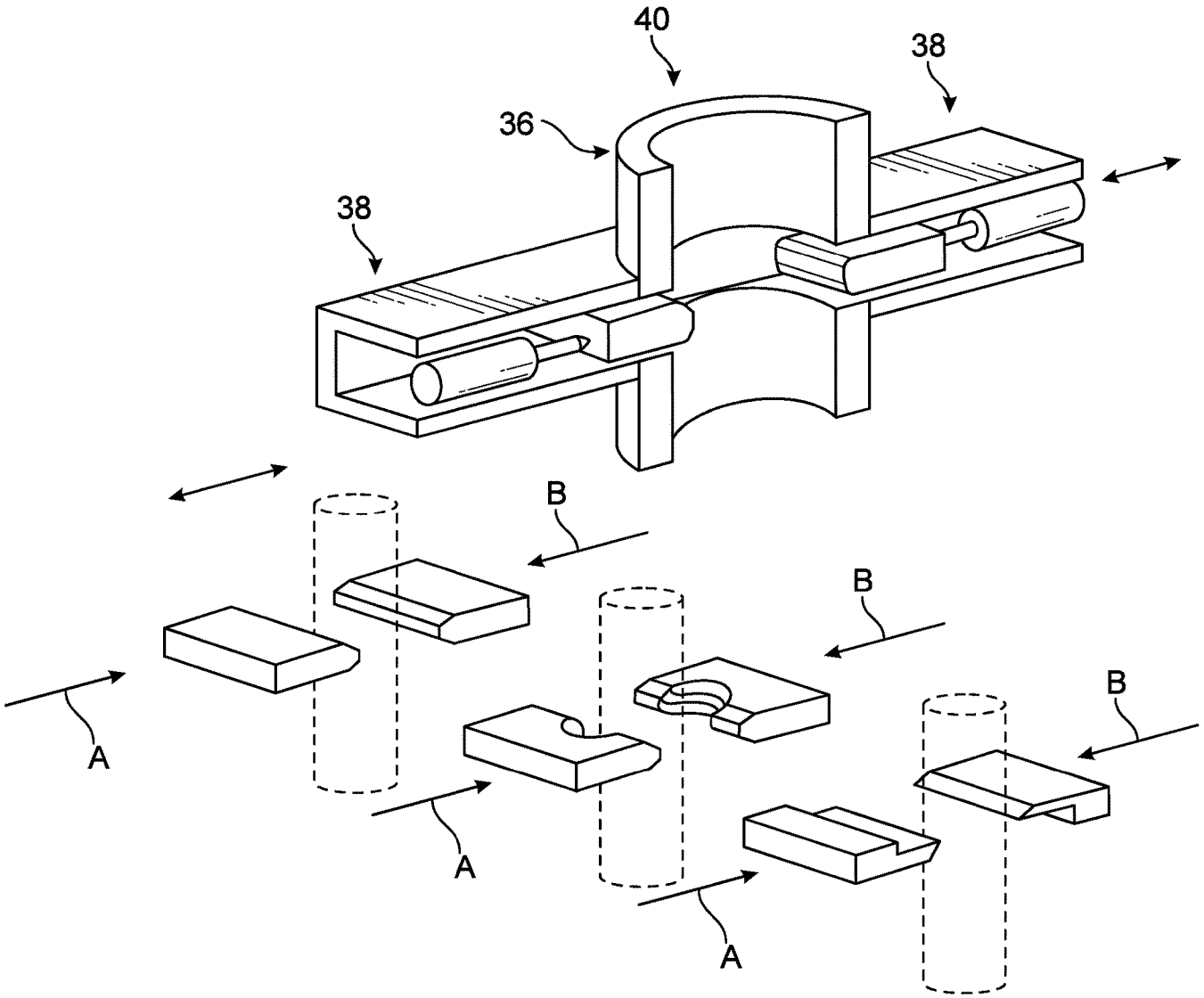
FIG. 5 (Prior Art)
FIG. 5: shows a perspective view in cross section of a blowout preventer and three different types of ram assemblies.

FIG. 5 shows, in perspective, a preventer 36, bonnet assemblies 38, a central bore 40, and different types of ram assemblies and how they move (according to arrows A and B) when closing on an object placed within a bore.

From left to right FIG. 5 shows, a blind ram (used for sealing a bore), a pipe ram, and a shear ram. An additional type of ram (variable rams) have not been expressly dealt with. These rams include a recess at the front face of the ram which is 'variable' for accommodating drill pipes of different diameter.

Figure 6:
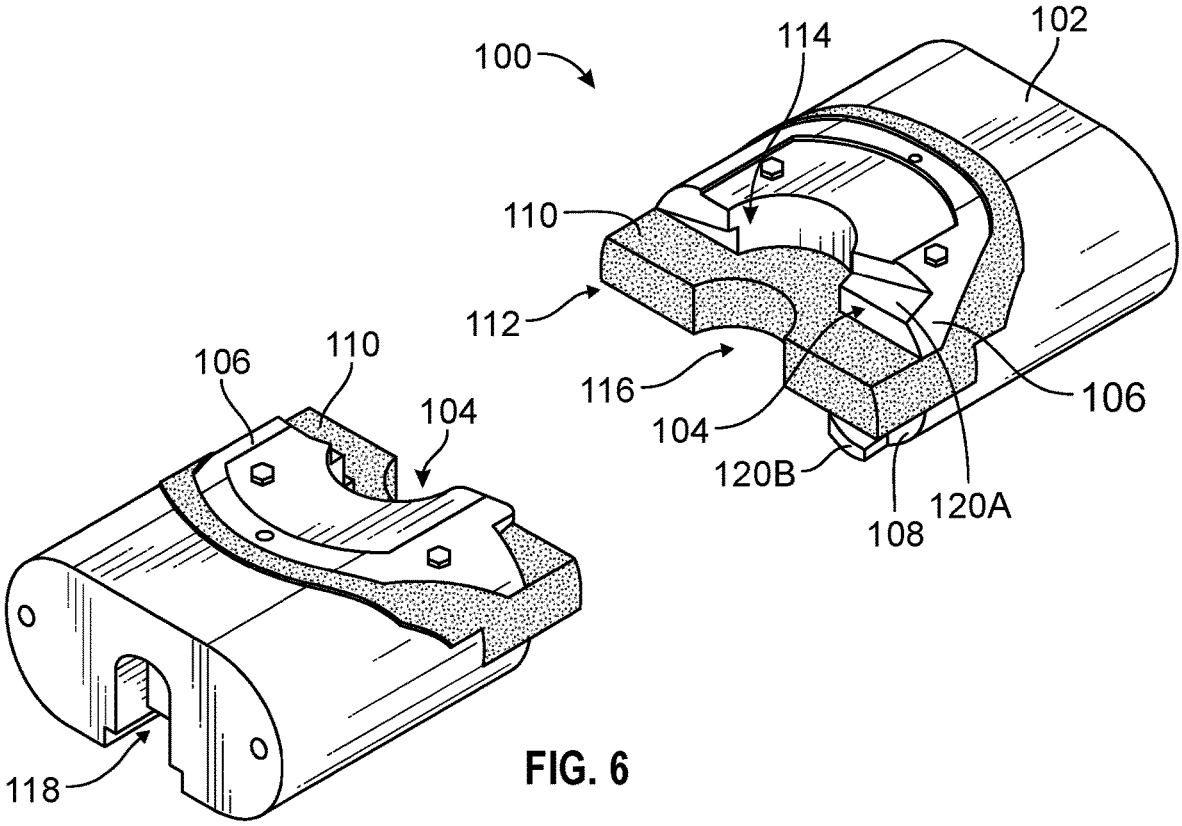
FIG. 6: shows a perspective view of the pipe ram packer assembly in accordance with the invention.

Turning now to FIG. 6 which shows a pipe ram assembly in accordance with the invention. The object of the current invention is to provide an improved packer assembly which is compatible with the bonnets 18, 38 of blowout preventers 10, 36 discussed above. Further for the improved packer assemblies to replace, or at least be interchangeable, with the ram packer assemblies currently available in the art, such as packer assemblies 20, 20A and 20B.

Therefore, FIG. 6 shows a packer assembly 100 for a pipe ram in accordance with the invention.

The assembly 100 includes a packer body 102, having a front face 104 comprising an upper plate 106 and a lower plate 108. Positioned between the plates is a packing material 110 having a front surface 112, wherein the material is a collapsible metal material.

The packing 110 extends past the front face 104 of the upper plate 106 and the lower plate 108.

The packing is a metal material composed of alloy 718 or stainless steel A182 or aluminium metal. Persons familiar in the art may recognize that the material may be composed of any metal which is other than alloy 718, stainless A182 or aluminium, provided such metal is sufficiently collapsible by deformation (e.g. collapsible to deform around an outer periphery of a drill pipe to seal the annulus in a preventer bore).

The material may be chosen from a metal material shown to exhibit anti-corrosive properties, such anti-corrosive properties may require the metal to withstand $H_2S$ concentrations of up to and above 35% when forming the mechanical seal. In one or more embodiments the material is required to form the seal in "high sour" formations.

The material is composed of a metal which is resilient to mechanical wear or degradation, either as a result of temperature fluctuations or chemical influences or pressure variations.

The material resists beading or crumbling or similar degradation which results in parts of the packing breaking off and flowing into the bore.

The upper plate 106 and the lower plate 108 include a recess 114 for receiving a drill pipe. The recess may be in the form of an arcuate cut-out of the front face, the arcuate shape may vary from ram to ram depending on the diameter of the drill pipe.

The packing 110 includes a recess 116 for receiving a drill pipe. The recess may be in the form of an arcuate cut-out of the front face, the arcuate shape may vary from ram to ram depending on the diameter of the drill pipe.

The packer body 102 includes an attachment arrangement 118, opposite the surface 104, for attaching the body to a means for moving the rams.

The packer body 102 includes keying formations 120A and 120B, respectively, along the front face 104. The keying formations, 120A and 120B, of opposing packer bodies may engage and guide opposing rams, when brought together, to interlock to align the opposing rams.

Figure 7:
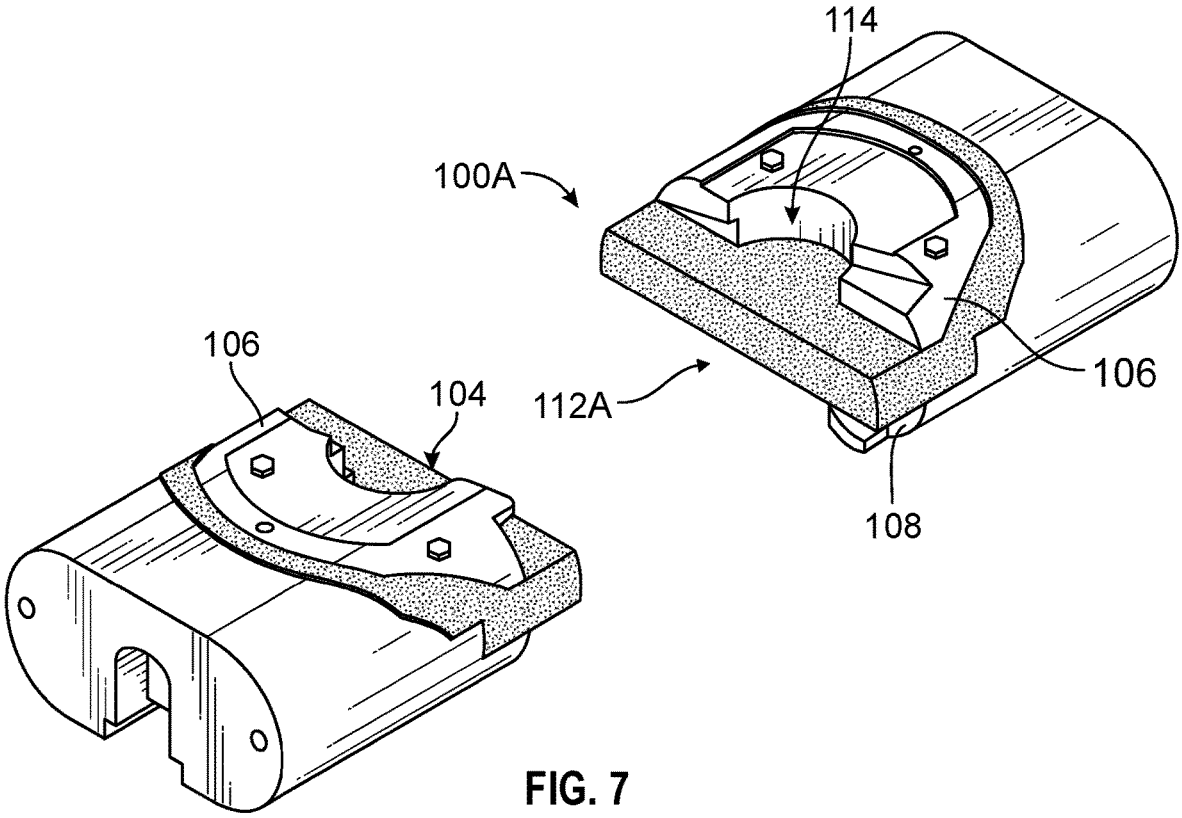
FIG. 7: shows a perspective view of the pipe ram packer assembly in accordance with a further embodiment of the invention.

FIG. 7 shows packer assembly 100A in accordance with a further embodiment of the invention. The assembly shows packing 110 having a substantially uniform front surface 112A, that is to say, the recess 114 as shown in FIG. 6, is absent.

Figure 8:
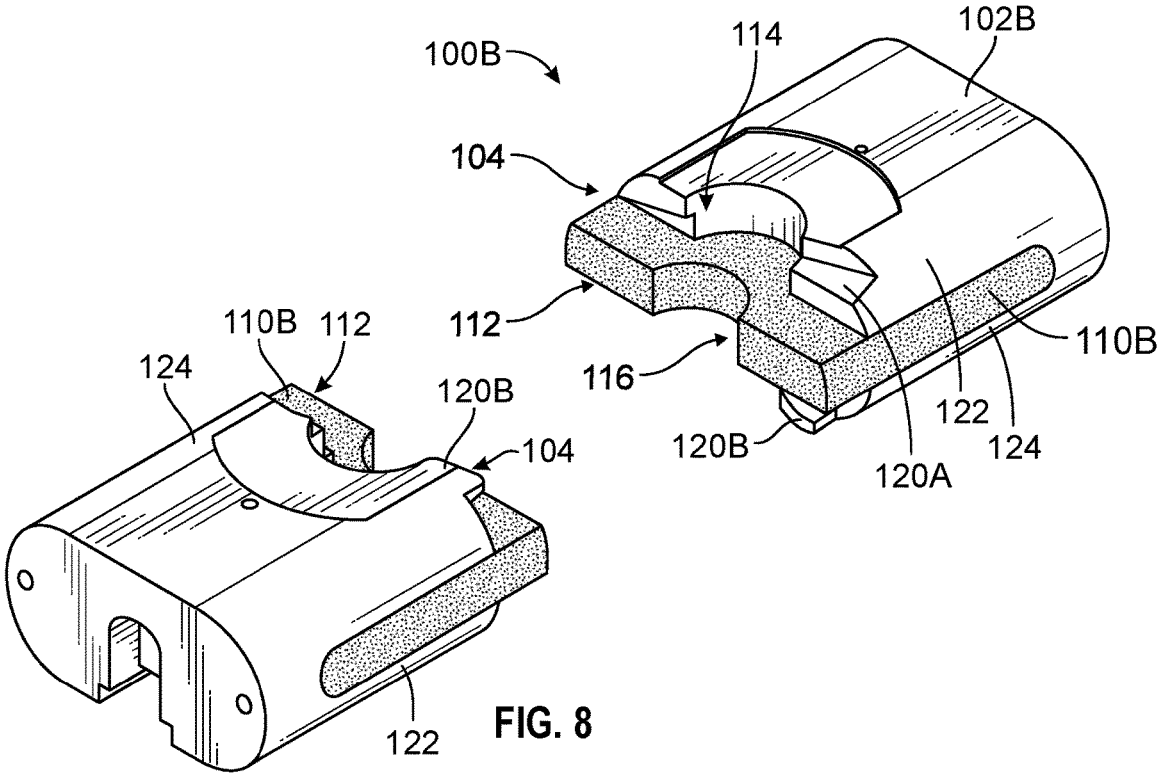
FIG. 8: shows a perspective view of the pipe ram packer assembly in accordance with a further embodiment of the invention.
Figure 9A:
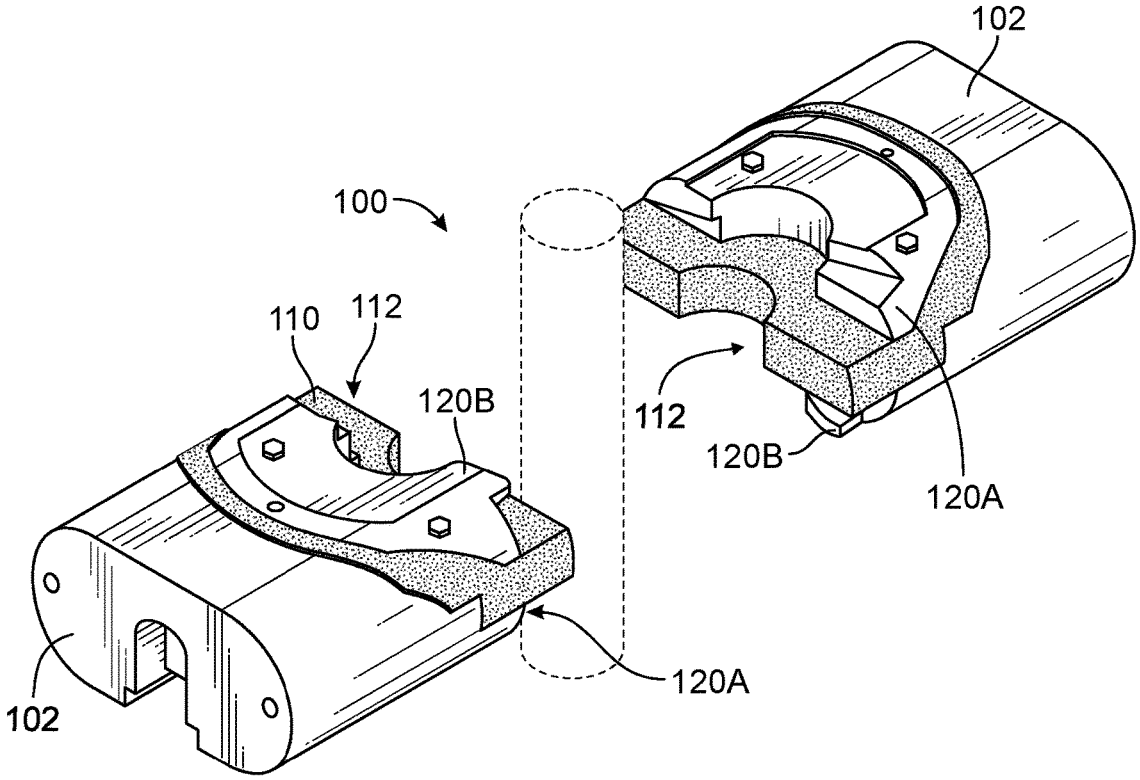
FIG. 9: shows in a perspective view, the use of the pipe ram assembly in accordance with the invention, in a stepwise fashion.
Figure 9B:
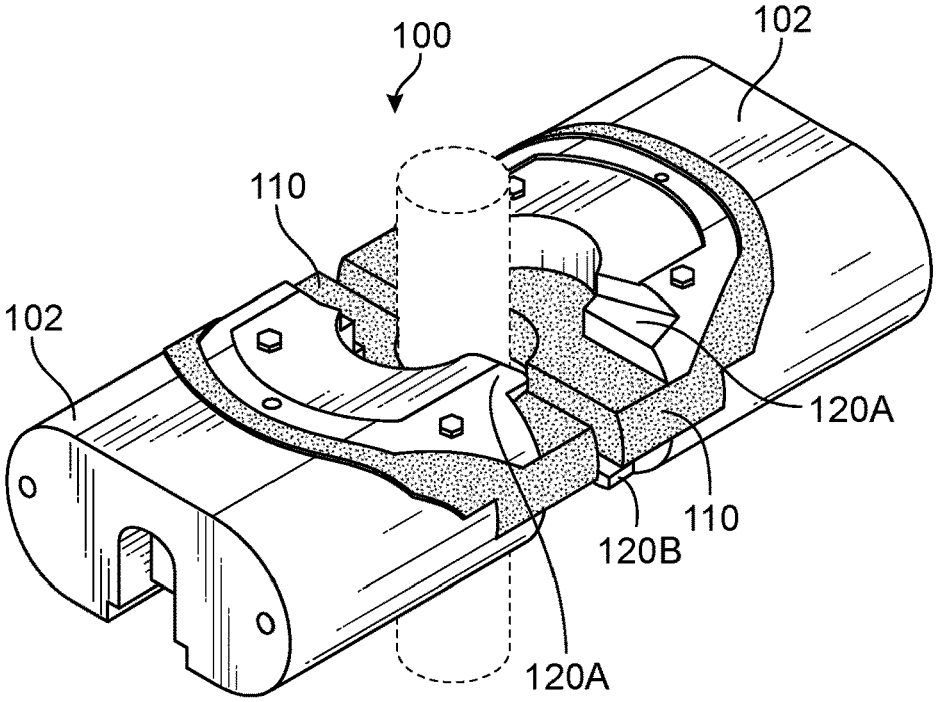
Figure 9C:
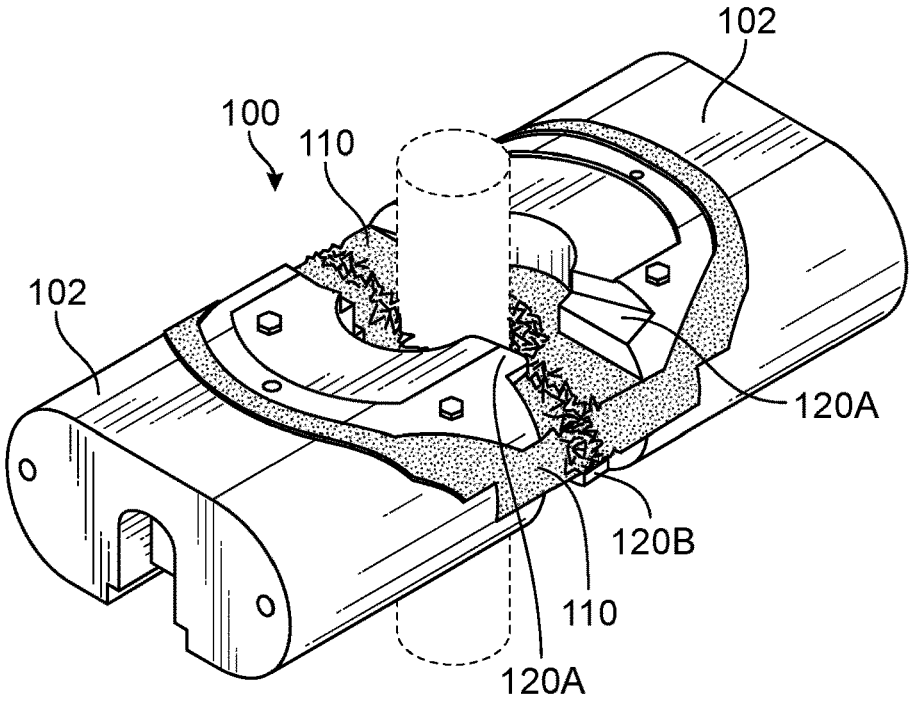
Figure 9D:
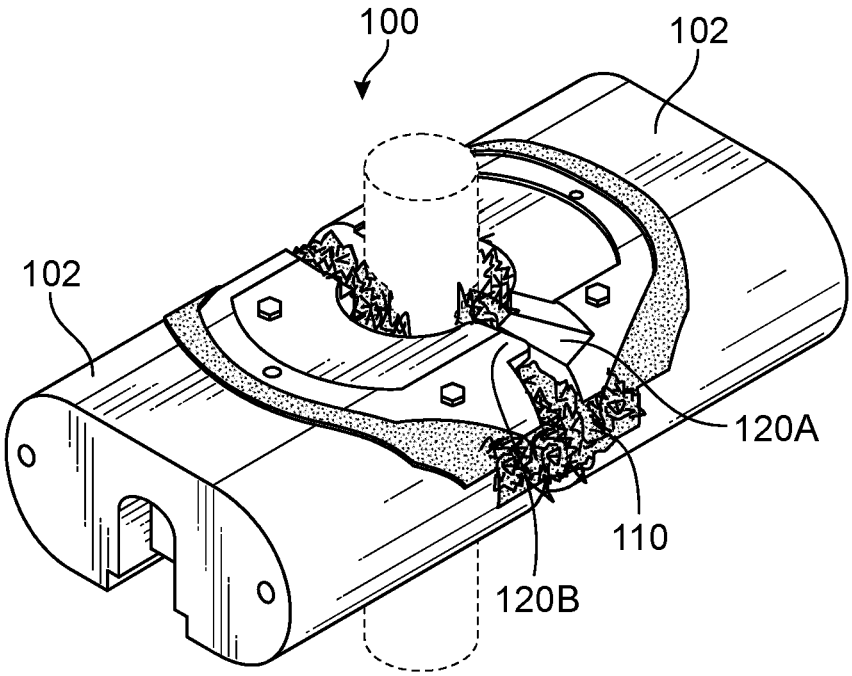
Figure 9E:
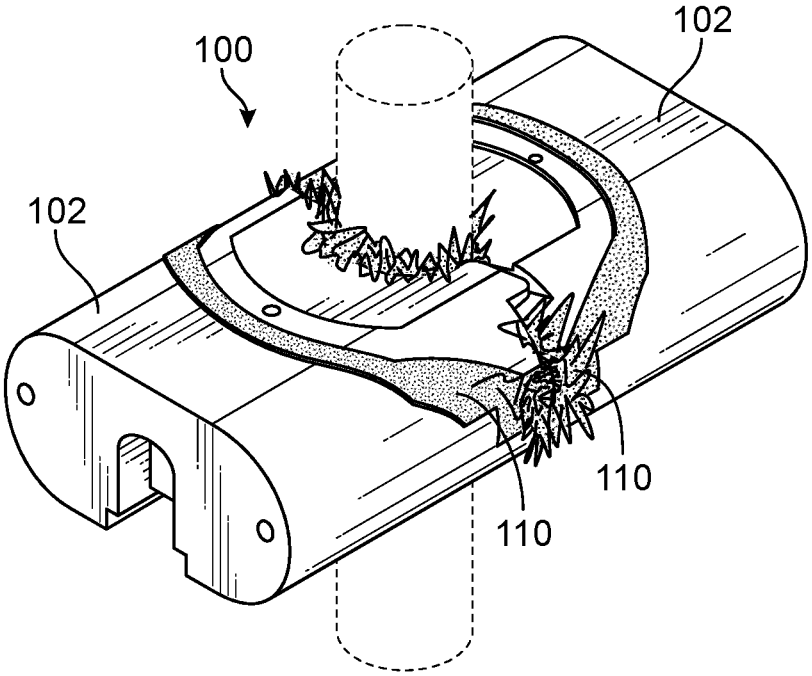

Turning to FIG. 8, which shows the packer assembly 100B in accordance with a further embodiment of the invention.

Packer assembly 100B includes a packer body 102B which is substantially U-shaped and comprises a pair of opposing arms 122 and 124.

The packing material 110B is positioned between the opposing arms, 122 and 124 respectively.

The front face 104 is formed by each distal end of the opposing arms, 122 and 124.

The packing 110 extends past the front face 104 of the packer body 102B.

The packer body 100B include a recess 114 for receiving a drill pipe, which recess is formed in the distal ends of the opposing arms 122 and 124. The recess may be in the form of an arcuate cut-out of the front face, the arcuate shape may vary from ram to ram depending on the diameter of the drill pipe.

The packing 110 includes a recess 116 for receiving a drill pipe. The recess may be in the form of an arcuate cut-out of the front face, the arcuate shape may vary from ram to ram depending on the diameter of the drill pipe.

Ram packer assemblies, of the kind described, are depicted in FIG. 9. The Figure shows, through FIGS. 9A to 9E, stepwise the manner in which the parking 110 collapses when the ram assemblies 100 are brought into contact with an object, which in this instance is a drill pipe.

FIG. 9 shows the packer assemblies 100 without the preventer 10, but it is to be understood that the movement of the rams is translatable to the inward or outward movement of the rams within the preventer as it moves through the bonnets.

The packer assemblies 100, when brought together (e.g. inwardly) will close the annulus in the vertical bore 16. The front surface 112 of the packing material 110 will contact the drill pipe first, providing metal-to-metal contact between the outer periphery of the pipe and the packing material.

Further inward movement of the packer assemblies 100 will squeeze the packing material 110 around the drill pipe. The packing, being of a collapsible material and being of a hardness less than that of the pipe, deforms around the pipe. Continued inward movement of the assemblies deforms the packing further which results in a ruffling of packing material.

The packing material 110, which is pressed into firm abutment with the pipe, forms a metal-to-metal seal between the packing and the pipe. The front face 104 of the packer body 102 continues to close on the pipe, such that keying formations 120A and 120B interlock to align the rams and compliment the seal. The annulus of the bore is effectively sealed with a metal 'washer', as opposed to an elastomeric seal or rubber seal as is currently in the art.

The seal is formed by the metal-to-metal abutment between the pipe and the packing material 110. This seal is less susceptible to temperature fluctuations or chemical influences. The packing overcomes shortcomings of the elastomeric material currently being used in ram packers, such elastomeric materials being susceptible to degradation under high or low temperatures, or chemical influences such as formations of high sourness or high $H_2S$ concentrations, particularly above 35%.

The improved packer assembly 100 provides for a single operation in sealing off a well bore wherein collapsed packing material 110 must be replaced after use. As the ram is moved outwardly so the packing will retain the collapsed and ruffled shape (e.g. the packing will not spring back to its original form, or the form it had prior to being placed in abutment with the pipe). That the packing is not an elastomeric material and require that the rams, or the packing material of the rams, be replaced after use.

The packer body 102 is interchangeable with the current packers common in the art, further the packer body 102 is compatible with the bonnets 18, 36 and preventers 10, 36 available in the art.

The collapsible deformable metal material provides for an improved seal of the annulus and seal around the drill pipe when the rams are moved inwardly. The improved packer makes exploration activities for such fields due to barrier assurances during operations, the improved packers can unlock high sour formations potential where it gives drillers extra mechanical barrier confirmation for longer periods to control the well.

While selected embodiments have been selected to be illustrated of the present invention, and specific examples have been described herein, it will be obvious to those skilled in the art that various changes and modifications may be aimed to in the specification. It will, therefore, be understood by those skilled in the art that the particular embodiments of the invention presented here are by way of illustration only, and are not meant to be in any way restrictive; therefore, numerous changes and modifications may be made, and the full use of equivalents resorted to, without departing from the spirit or scope of the invention.

The invention claimed is:

1. A packer assembly for a pipe ram wherein the assembly comprises:

a packer body having a front face, the packer body comprising an upper plate and a lower plate; and a packing having a front surface for engaging an object, the packing positioned between the plates, wherein;

the packing is a collapsible metal material.

2. A packer assembly as claimed in claim 1 wherein the metal material is selected from one of the following; alloy metal 718, stainless steel A182, aluminium or a metal other than alloy metal 718 or stainless steel A182 or aluminium, provided such metal is sufficiently collapsible to deform around an outer periphery of a drill pipe.

3. A packer assembly as claimed in claim 1 wherein the metal material is selected from anti-corrosive metals designed to withstand 'high sour' formations.

4. A packer assembly as claimed in claim 3 wherein the 'high sour' formations include formations which exhibit H2S concentrations above 35%.

5. A packer assembly as claimed in claim 1 wherein the metal material is heat resistant.

6. A packer assembly as claimed in claim 5 wherein the heat resistance includes temperatures at or above about 2500 C.

7. A packer assembly as claimed in claim 1 wherein the metal material includes chemical influence resistance.

8. A packer assembly as claimed in claim 1 wherein the metal material is resistant to mechanical wear, degradation and beading.

9. A packer assembly as claimed in claim 1 wherein the packer body is compatible with a cavity of a blowout preventer and interchangeable with a ram front packer.

10. A packer assembly as claimed in claim 1 wherein the upper plate and the lower plate include a recess in the front face for receiving a drill pipe.

11. A packer assembly as claimed in claim 1 wherein the packing includes a recess in the front surface for receiving a drill pipe.

12. A packer assembly as claimed in claim 1 wherein the packing includes a substantially planer surface in the front surface for receiving a drill pipe.

13. A packer assembly as claimed in claim 1 wherein the packer body includes at least one keying formation along the face.

14. A packer assembly as claimed in claim 1 wherein the packer body is substantially U-shaped, having a pair of opposing arms connected at their proximal ends.

15. A packer assembly as claimed in claim 14 wherein the front face is formed by the distal ends of the opposing arms.

16. A packer assembly as claimed in claim 15 wherein the packing is positioned between the opposing arms.

17. A packer assembly as claimed in claim 16 wherein the distal ends of the opposing arms include a recess for receiving a drill pipe.

18. A packer assembly as claimed in claim 1 wherein the packing extends past the front face.

19. A packer assembly as claimed in claim 1 wherein the packing is replaceable after use.

20. A packer assembly as claimed in claim 1 wherein the packer body is interchangeable with packers common in the art.

21. A packer assembly as claimed in claim 1 wherein the packer body is compatible with bonnets and preventers available in the art.

* * * * *